US006596934B2

(12) United States Patent
Hsieh

(10) Patent No.: US 6,596,934 B2
(45) Date of Patent: Jul. 22, 2003

(54) ADJUSTABLE RETAINING DEVICE FOR A BASS DRUM

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 09/886,750

(22) Filed: Jun. 22, 2001

(65) Prior Publication Data

US 2002/0194980 A1 Dec. 26, 2002

(51) Int. Cl.[7] ..... G10D 13/02
(52) U.S. Cl. ..... 84/422.1; 84/422.1; 84/422.3
(58) Field of Search ..... 84/422.1, 422.2, 84/422.3

(56) References Cited

U.S. PATENT DOCUMENTS 5,185,489 A * 2/1993 Hoshino ..... 84/422.1
5,565,637 A 10/1996 Shigenaga ..... 84/422.1
6,011,208 A 1/2000 Hoshino ..... 84/422.1
6,331,666 B1 12/2001 Rubbert ..... 123/295

* cited by examiner

*Primary Examiner*—Kim Lockett
(74) *Attorney, Agent, or Firm*—Alan Kamrath; Rider, Bennett, Egan & Arundel, LLP

(57) ABSTRACT

An adjustable retaining device for a bass drum has a positioning plate securely engaged with the base, a first clamping plate pivotally connected with the position plate and a second clamping plate selectively engaged with and movable relative to the first clamping plate. A torque device engaged with the second clamping plate and having at least two rods securely extending out. The at least two rods slidably extend through the second clamping plate to allow the second plate to move with respect to the first clamping plate so as that a position of the second clamping plate is changeable with respect to the first clamping plate.

15 Claims, 8 Drawing Sheets

ADJUSTABLE RETAINING DEVICE FOR A BASS DRUM

BACKGROUND OF THE INVENTION

1. Field of the Invention

The present invention relates to an adjustable retaining device for a bass drum with which the peripheral edge of the bass drum is able to be securely clamped without any damage to or tilting of the bass drum.

2. Description of Related Art

With reference to FIG. 8, a conventional retaining device (60) for a bass drum has an upright stand (not numbered), a base (61) and a clamping arm (63). The upright stand securely extends upward from the base (61). The base (61) a slanted upper face (62) extending out from the upright stand. The clamping arm (63) is pivotal with respect to the base (61) and aligns with the slanted upper face (62) of the base (61). An adjusting screw (64) extends through the clamping arm (63) to engage the slanted upper face (62). When the retaining device is used to secure the peripheral edge of a bass drum (70), the adjusting screw (64) is screwed into the slanted upper face (62) of the base (61). The adjusting screw (64) forces the clamping arm (63) to pivot downward toward the slanted upper face (62) of the base (61). As the clamping arm (63) approaches the slanted upper face (62), the peripheral edge of the bass drum (70) is securely clamped between the clamping arm (63) and the slanted upper face (62).

However, because the upper face (62) of the base (61) is inclined and the bottom face of the clamping arm (63) is flat, the clamping arm (63) does not engage the slanted upper face well. The clamping arm (63) only exerts even pressure on the upper face (62) when the clamping arm (63) and the upper face (62) are in actual contact. Consequently, the bass drum (70) might tilt due to the uneven pressure between the slanted upper face (62) of the base (61) and the clamping arm (63) as the clamping arm (63) is pivoting downward relative to the base (61).

Furthermore, when this type of retaining device is with the clamping arm (63) fixed with respect to the base (61) is used, the entire retaining device together with the striking mechanism (not shown) must be moved to clamp the edge of the bass drum in a different position, which is troublesome and time consuming.

To overcome the shortcomings, the present invention tends to provide an improved adjustable retaining device to mitigate and obviate the aforementioned problems.

SUMMARY OF THE INVENTION

The primary objective of the present invention is to provide an adjustable retaining device for a bass drum. The adjustable retaining device includes a position plate, a first clamping plate and a second clamping plate. The position plate is securely mounted on the base and has an arcuate top face. The first clamping plate is pivotally connected to the position plate and has a bottom, a top and an arcuate recess in the bottom to receive the arcuate top face of the position plate. The second clamping plate is movable relative to and selectively engaged with the first clamping plate. The engagement between the arcuate top face of the position plate and the arcuate recess of the first clamping plate ensures secure and smooth positioning of the clamping surfades of the first and second clamping plates on the periphery of the bass drum.

Another objective of the invention is to provide a torque device to drive the second clamping plate to move toward the first clamping plate so as to secure the periphery of the bass drum with the first clamping plate.

Still another objective of the invention is to provide an adjusting device to the adjustable retaining device so that only part of the adjustable retaining device is moved.

Other objects, advantages and novel features of the invention will become more apparent from the following detailed description when taken in conjunction with the accompanying drawings.

DETAILED DESCRIPTION OF PREFERRED EMBODIMENT

Figure 1:
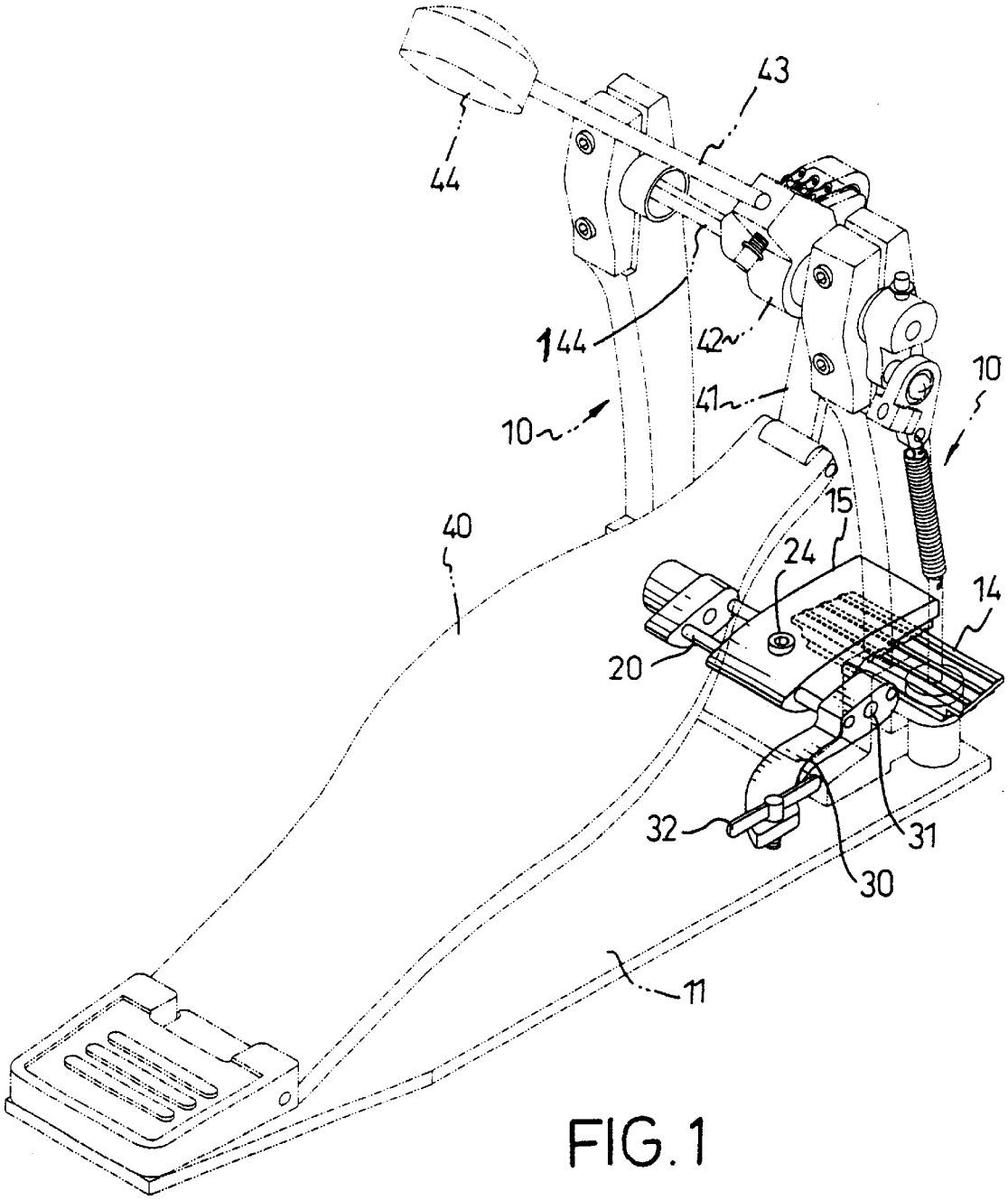
FIG. 1 is a perspective view of the adjustable retaining device in accordance with the present invention.

With reference to FIG. 1, the striking mechanism for a bass drum includes a base (11), a pedal (40), an upright stand (10), a linkage assembly and a drumstick. The pedal (40) is pivotally mounted on the base (11). The base (11) and the pedal (40) respectively have a proximal end closest to the drummer and a distal end closest to the drum. The upright stand (10) is connected to and extends up the distal end of the base (11) and is connected to the distal end of the pedal (40) by a linkage assembly. The linkage assembly consists of a shaft (144), a block (42) and a linkage (41). The shaft (144) is rotatably connected to two poles (not numbered) of the stand (10). The block (42) is securely mounted on the shaft (144) between the two poles. The linkage (41) has two ends with one end eccentrically and pivotally connected to the block (42) and the other end pivotally connected to the distal end of the pedal (40). The drumstick comprises a drumstick shaft (43) and a drumstick head (44). The drumstick shaft (43) has two ends with one end securely connected to the block (42) and the drumstick head (44) attached to the other end. With such an arrangement, the up and down movement of the pedal (40) initiates the rotary movement of the shaft (144), which causes the drumstick head (44) to swing in an arc and strike the drum. Since how the striking mechanism works is not the focus of the invention, further description is omitted from the following description.

Figure 2:
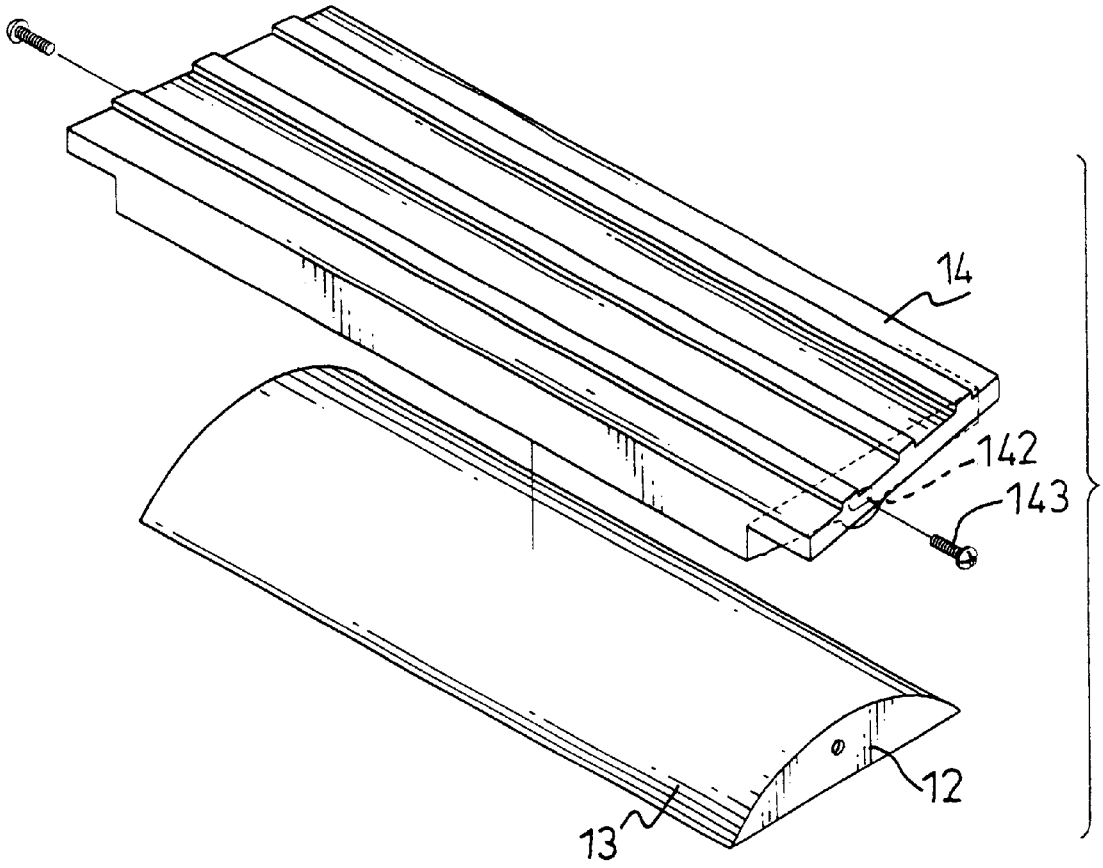
FIG. 2 is an enlarged exploded perspective view of the position plate and the first clamping plate in FIG. 1.
Figure 3:
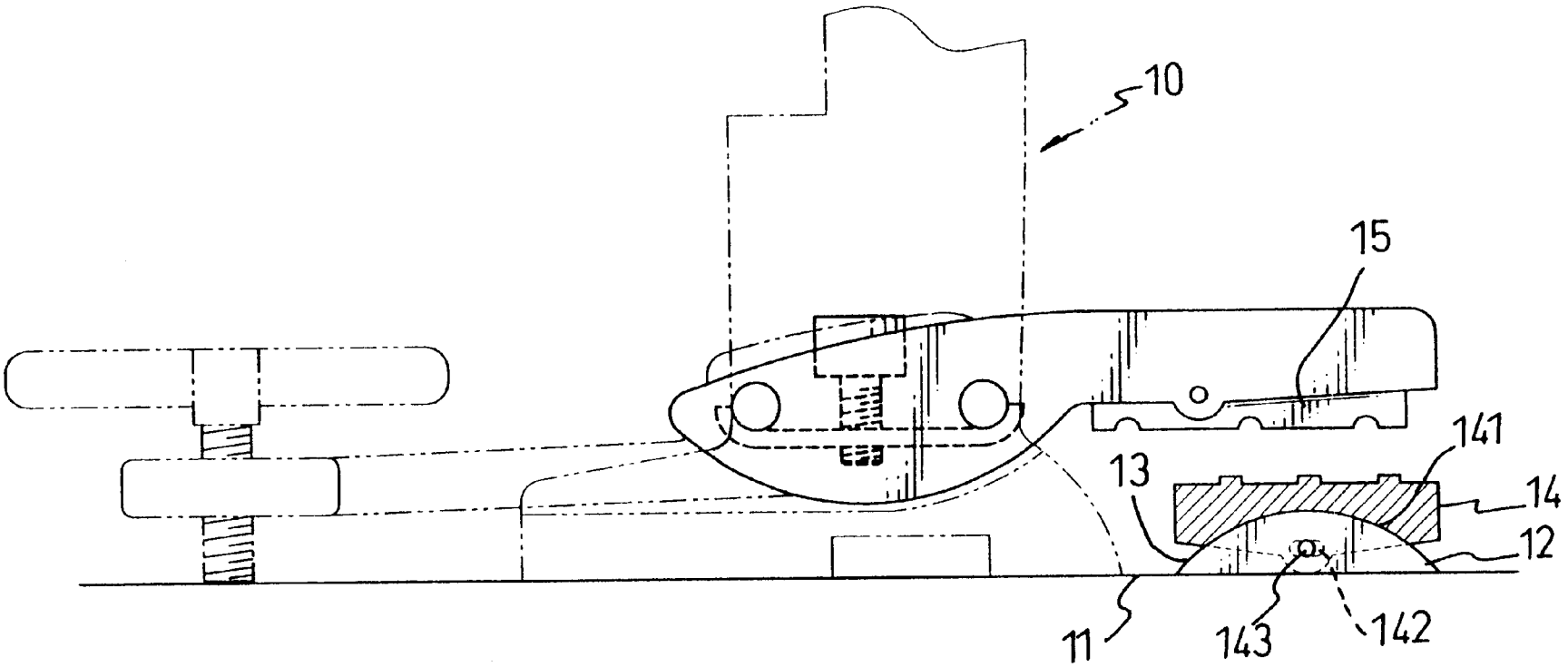
FIG. 3 is a side plan view in partial section of the position plate and the first clamping plate in FIG. 1, wherein for clarity the torque device is omitted from the drawing.

With reference to FIGS. 2 and 3, the adjustable retaining device in accordance with the present invention includes a position plate (12), a first clamping plate (14), a second clamping plate (15) and a torque device (30).

With reference to FIGS. 1, 2 and 3, the position plate (12) is securely attached to the base (11) and has an arcuate top face (13). The first clamping plate (14) has a top and bottom face and two side faces. An arcuate recess (141) is defined in the bottom face of the first clamping plate (14) to correspond to the arcuate top face (13) of the position plate (12). A pivot hole (142) is defined through each side face of the first clamping plate (14). A pivot device (143) such as a bolt, rivet or the like extends through the pivot hole (142) to securely connect to a side face of the position plate (12). With the arcuate top face (13) in the arcuate recess (141) of the first clamping plate (14) and the pivot device (143) through the pivot hole (142) and securely connected to the position plate (12), the first clamping plate (14) is pivotal with respect to the position plate (12).

Figure 4:
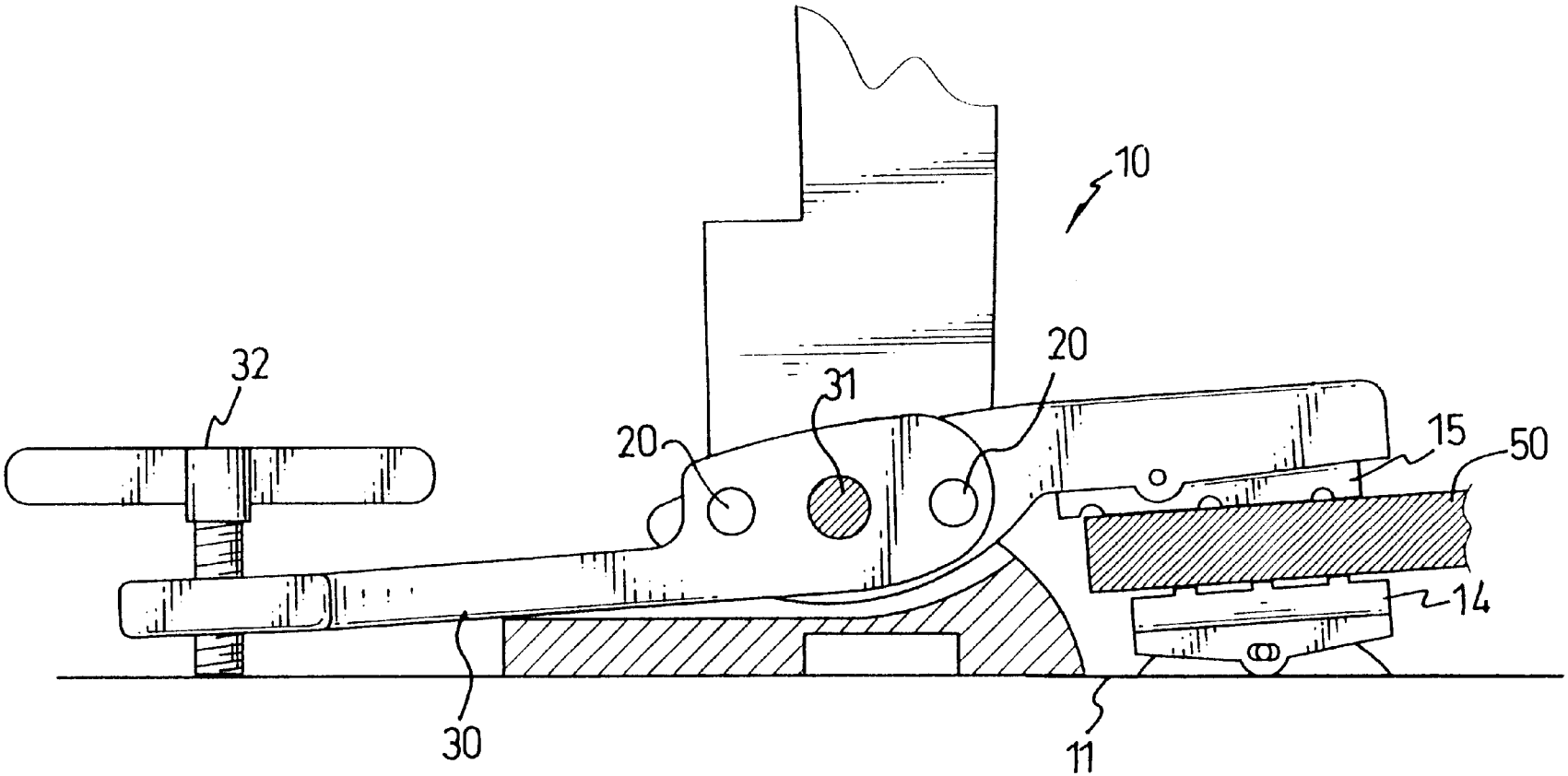
FIG. 4 is an operational side plan view of the adjustable retaining device in FIG. 1 showing the relationship between the torque device and the second clamping plate.
Figure 5:
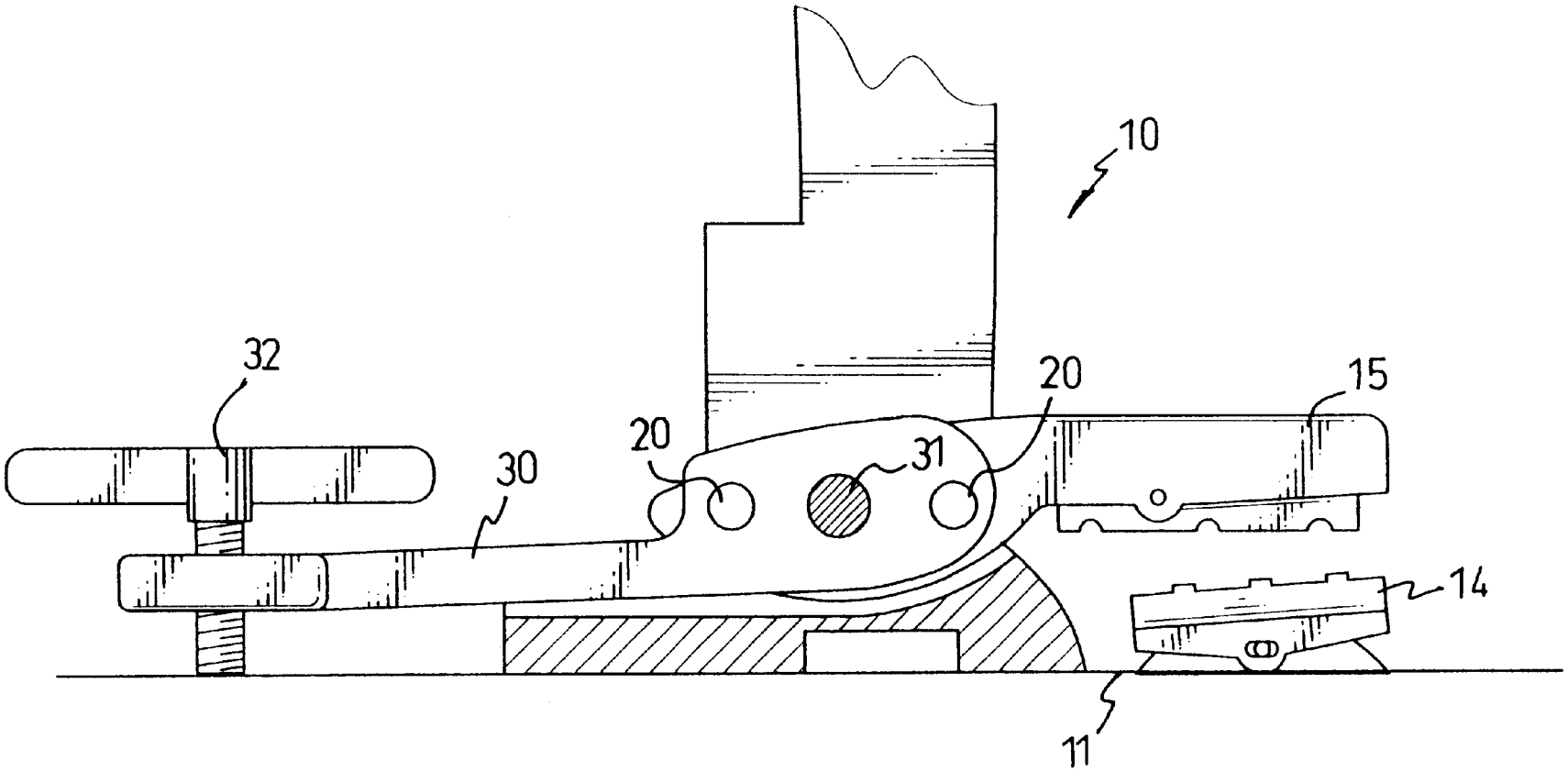
FIG. 5 is an operational side plan view of the adjustable retaining device in FIG. 1 showing the movement of the torque device with respect to the stand.
Figure 6:
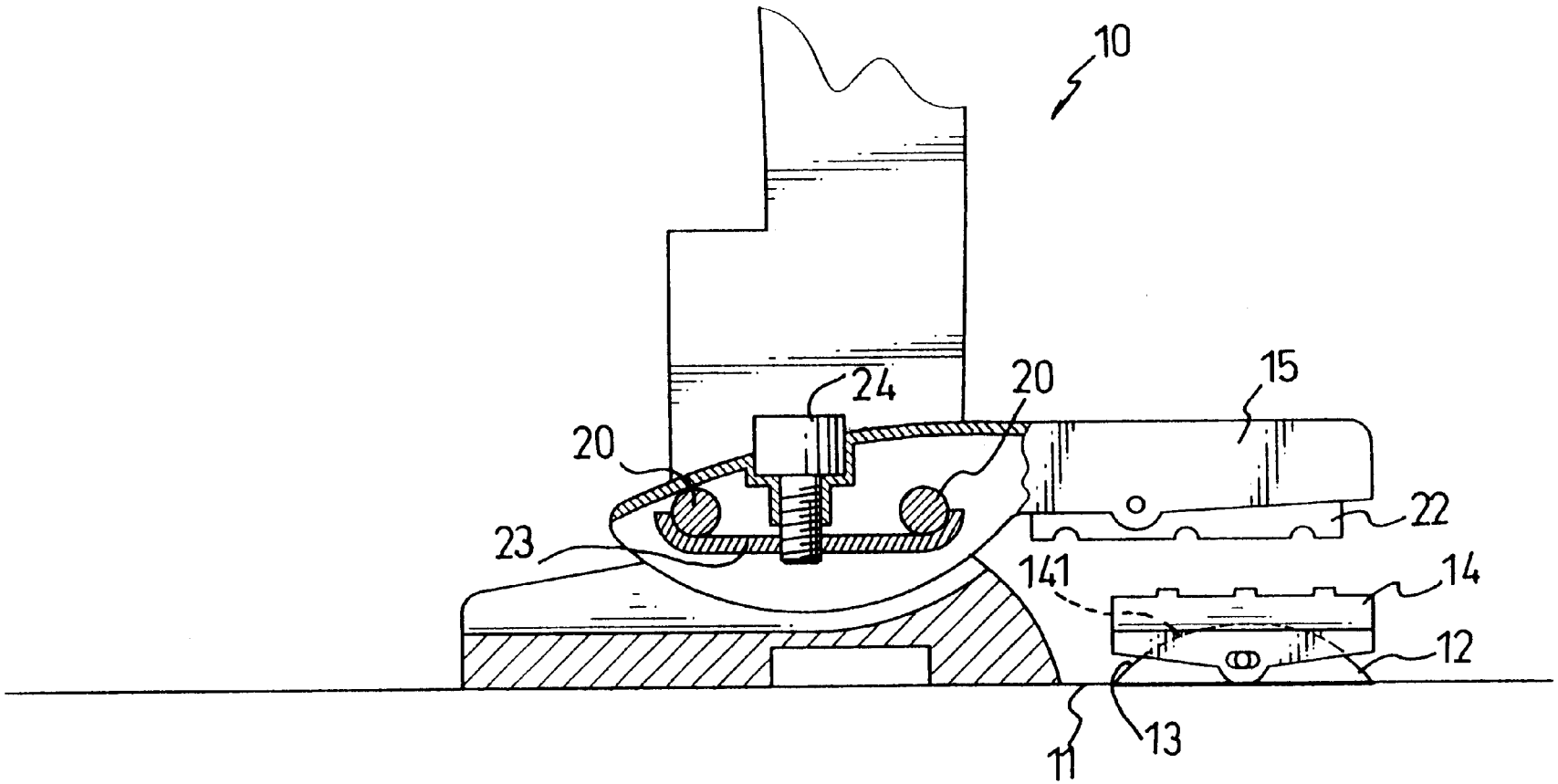
FIG. 6 is a side plan view of the adjustable retaining device in FIG. 1 showing an adjusting screw employed to secure the movement of the second clamping plate with respect to the first clamping plate.
Figure 7:
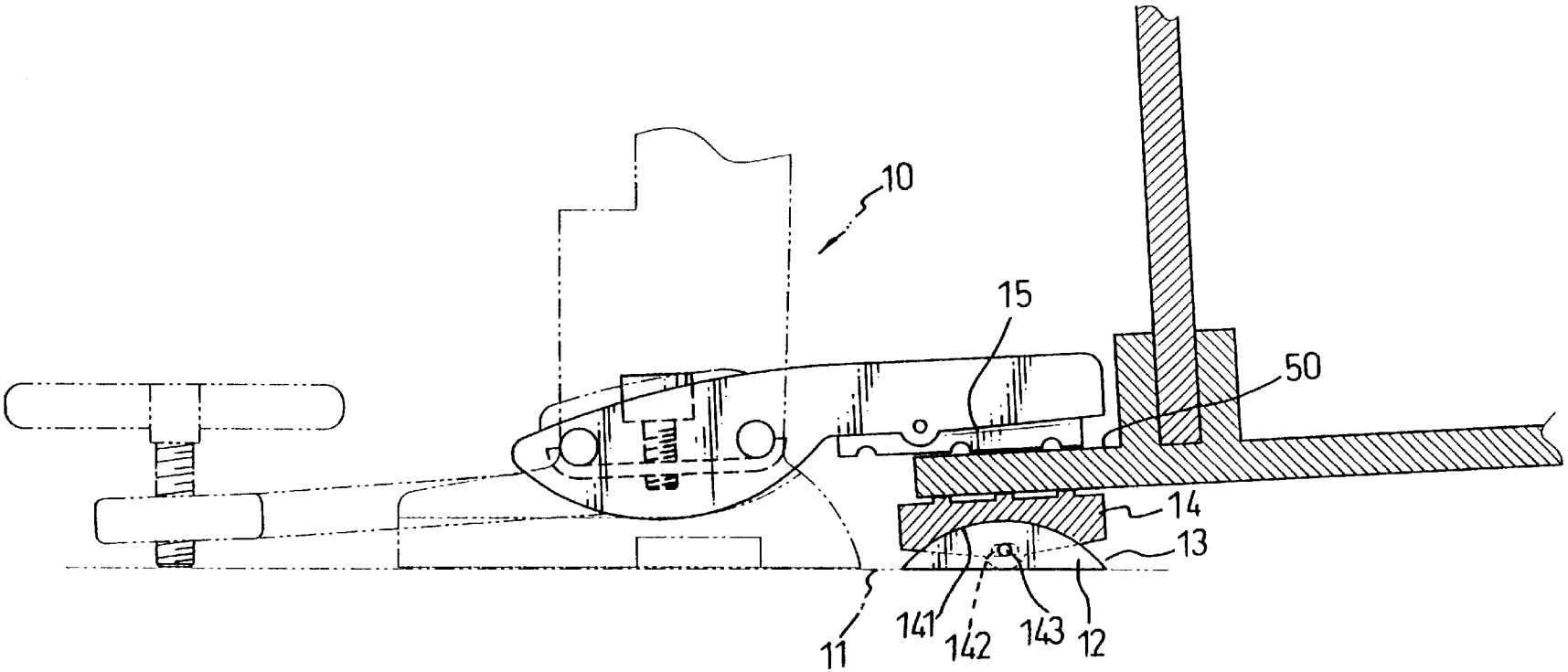
FIG. 7 is a side plan view of the adjustable retaining device in FIG. 1 showing the periphery of the bass drum secured by the adjustable retaining device.
Figure 8:
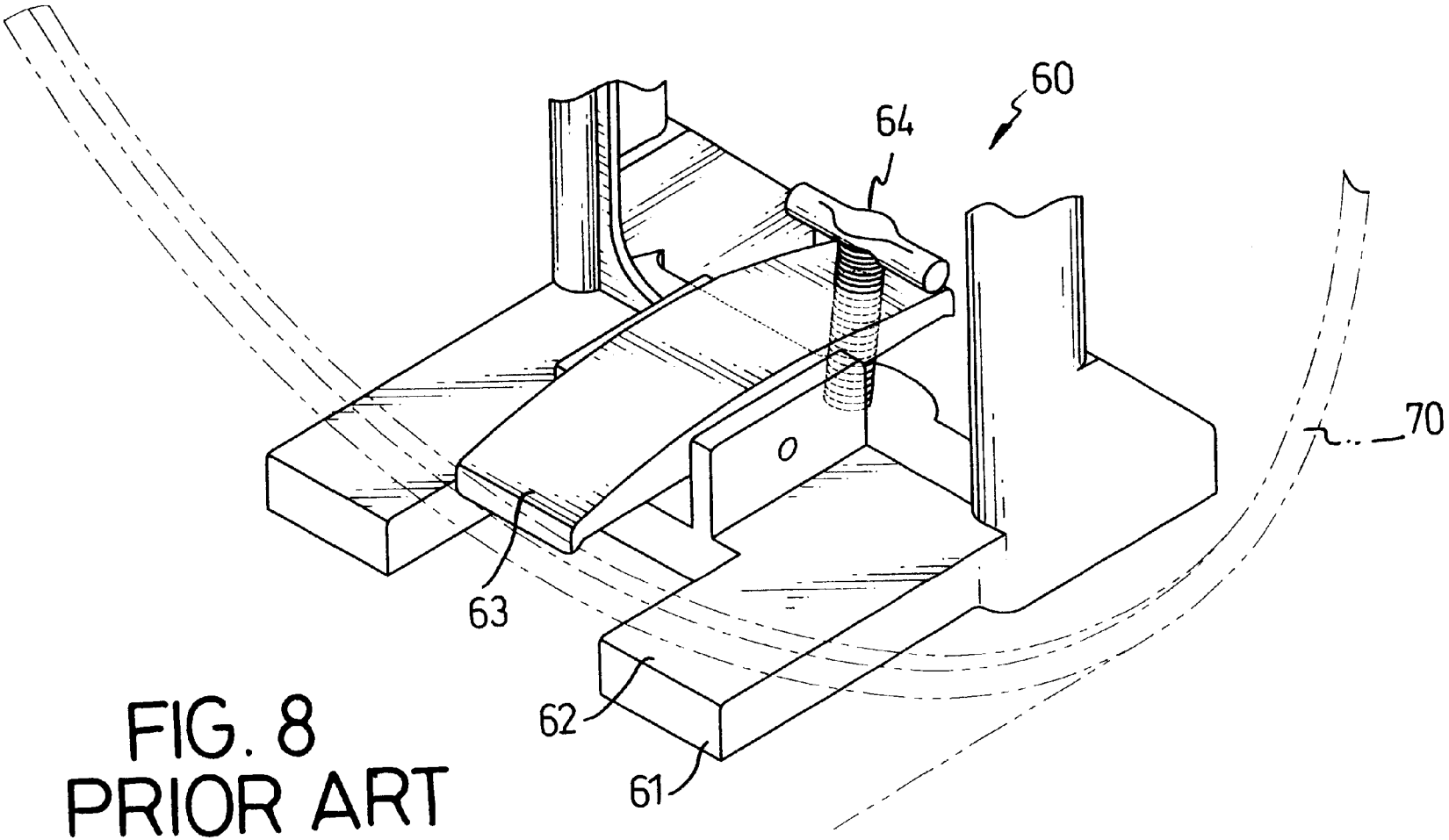
FIG. 8 PRIOR ART
FIG. 8 is a side plan view of a conventional retaining device.

With reference to FIGS. 4, 5 and 6, the second clamping plate (15) is laterally movable relative to the first clamping plate (14) and is supported by the torque device (30) by means of at least two rods (20) extending between two poles of the stand (10) and through the second clamping plate (15) and the torque device (30). The torque device (30), preferably a lever, has a supporting shaft (31) extending to and securely engaging with the stand (10) (as shown in FIG. 4) and an adjusting screw (32) provided at a first distal end of the lever (30) to engage with the base (11). A second distal end of the lever (30) securely connects to the second clamping plate (15). When the adjusting screw (32) is adjusted, the lever (30) pivots about the supporting shaft (31), such that the second distal end increases or decreases pressure on the second clamping plate (15). That is, when the first distal end of the lever (30) is depressed by the adjusting screw (32), the second distal end of the lever (30) tilts upward, which decreases pressure on the second clamping plate (15). Therefore, with reference to FIG. 4, when a peripheral edge of the bass drum (50) is to be clamped between the first clamping plate (14) and a pivotally mounted jaw (22) defining and being part of the second clamping plate (15), the user adjusts the adjusting screw (32) to depress the second distal end of the lever (30) to increase pressure on the second distal end of the lever (30). Accordingly, the descending of the second distal end of the lever (30) together with the second clamping plate (15) securely clamps the peripheral edge of the bass drum (50). Furthermore, the engagement between the arcuate top face (13) of the position plate (12) and the arcuate recess (141) of the first clamping plate (14) allows the first clamping plate (14) to pivot along the peripheral characteristics of the bass drum (50). That is, with reference to FIG. 7, the engagement between the arcuate top face (13) of the position plate (12) and the arcuate recess (141) of the first clamping plate (14) allows automatic offset to the peripheral features of the bass drum (50) to firmly engage the peripheral edge of the bass drum (50) and to prevent the bass drum (50) from tilting after being clamped.

Still, with reference to FIGS. 3 and 6, in order to clamp the peripheral edge of the bass drum (50), it is better to have the second clamping plate (15) movable with respect to the first clamping plate (14) such that the user only needs to move the second clamping plate (15) to clamp the peripheral edge of the bass drum (50) instead of moving the entire striking mechanism and the adjustable retaining device. To accomplish this, a fixing plate (23) is movably received in the second clamping plate (15) to support the at least two rods (20) and a securing nut (24) extend into the second clamping plate (15) to screw into the fixing plate (23). Therefore, tightening the securing nut (24) results in the at least two rods (20) being firmly clamped by the fixing plate (23) and an inner bottom face of the second clamping plate (15).

With this arrangement, the user is able to freely adjust the position of the second clamping plate (15) with respect to the first clamping plate (14) so as to have the best securing effect on the peripheral edge of the bass drum (50).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable retaining device for a bass drum, the adjustable retaining device comprising:

a first clamping plate;

a second clamping plate selectively engaged with the first clamping plate, with the second clamping plate being movable in an engagement direction upward away from the first clamping plate and descending toward the first clamping plate; and a torque device engaged with the second clamping plate to provide a force to the second clamping plate, with the second clamping plate being adjustably positionable in an adjustment direction perpendicular to the engagement direction relative to the first clamping plate for adjusting to the peripheral characteristics of the bass drum, wherein the second clamping plate has at least two rods slidably extending through the second clamping plate to securely engage with the torque device, a fixing plate received in the second clamping plate and a securing nut screwed into the fixing plate, whereby the at least two rods received between the second clamping plate and the fixing plate are selectively secured and thus a position of the second clamping plate with respect to the first clamping plate is fixed.

2. The adjustable retaining device as claimed in claim 1, with the torque device consisting of a lever that has a first end that securely engages the second clamping plate and a second end that has an adjusting screw to adjust the second end of the lever so as to adjust the second clamping plate with respect to the first clamping plate.

3. The adjustable retaining device as claimed in claim 2, with the second clamping plate being pivotal about a pivot axis which is perpendicular to the engaged direction and to the adjustment direction.

4. The adjustable retaining device as claimed in claim 3, further comprising a base, with the first clamping plate being pivotable relative to the base.

5. The adjustable retaining device as claimed in claim 4, further comprising a position plate securely engaged with the base, with the first clamping plate being pivotally engaged with the position plate, whereby the pivotal engagement between the first clamping plate and the position plate automatically offset the peripheral characteristics of the bass drum.

6. The adjustable retaining device as claimed in claim 2, further comprising a base, with the first clamping plate being pivotable relative to the base.

7. The adjustable retaining device as claimed in claim 6, further comprising a position plate securely engaged with the base, with the first clamping plate being pivotally engaged with the position plate, whereby the pivotal engagement between the first clamping plate and the position plate automatically offset the peripheral characteristics of the bass drum.

8. The adjustable retaining device as claimed in claim 1, with the second clamping plate being pivotal about a pivot axis which is perpendicular to the engaged direction and to the adjustment direction.

9. The adjustable retaining device as claimed in claim 8, further comprising a base, with the first clamping plate being pivotable relative to the base.

10. The adjustable retaining device as claimed in claim 9, further comprising a position plate securely engaged with the base, with the first clamping plate being pivotally engaged with the position plate, whereby the pivotal engagement between the first clamping plate and the position plate automatically offset the peripheral characteristics of the bass drum.

11. The adjustable retaining device as claimed in claim 1, further comprising a base, with the first clamping plate being pivotable relative to the base.

12. The adjustable retaining device as claimed in claim 11, further comprising a position plate securely engaged with the base, with the first clamping plate being pivotally engaged with the position plate, whereby the pivotal engagement between the first clamping plate and the position plate automatically offset the peripheral characteristics of the bass drum.

13. An adjustable retaining device for a bass drum, the adjustable retaining device comprising:

a first clamping plate;

a second clamping plate selectively engaged with the first clamping plate, with the second clamping plate being moveable in an engagement direction upward away from the first clamping plate and descending toward the first clamping plate;

a torque device engaged with the second clamping plate to provide a force to the second clamping plate, with the second clamping plate being adjustably positionable in an adjustment direction perpendicular to the engagement direction relative to the first clamping plate for adjusting to the peripheral characteristics of the bass drum; and a base, with the first clamping plate being pivotable relative to the base.

14. The adjustable retaining device as claimed in claim 13, with the second clamping plate being pivotal about a pivot axis which is perpendicular to the engaged direction and to the adjustment direction.

15. The adjustable retaining device as claimed in claim 13, further comprising a position plate securely engaged with the base, with the first clamping plate being pivotally engaged with the position plate, whereby the pivotal engagement between the first clamping plate and the position plate automatically offset the peripheral characteristics of the bass drum.

* * * * *